US007028414B2

(12) United States Patent
Vonplon

(10) Patent No.: US 7,028,414 B2
(45) Date of Patent: Apr. 18, 2006

(54) DEVICE FOR CONTINUOUS DRYING OF MATERIAL

(76) Inventor: Armin Vonplon, Wiesenstrasse 2, CH-8917, Oberlunkofen (CH)

( * ) Notice: Subject to any disclaimer, the term of this patent is extended or adjusted under 35 U.S.C. 154(b) by 0 days.

(21) Appl. No.: 10/835,489

(22) Filed: Apr. 29, 2004

(65) Prior Publication Data

US 2005/0241173 A1 Nov. 3, 2005

(51) Int. Cl.
*F26B 25/00* (2006.01)
*F26B 5/04* (2006.01)

(52) U.S. Cl. ..... 34/236; 34/382; 34/399; 34/481

(58) Field of Classification Search ..... 34/68, 34/116, 216, 236, 382, 392, 398, 399, 400, 34/481, 482
See application file for complete search history.

(56) References Cited

U.S. PATENT DOCUMENTS 3,864,840 A * 2/1975 Baskin ..... 34/290
4,245,396 A * 1/1981 Maffet ..... 34/386
4,263,239 A * 4/1981 Dunbar et al. ..... 264/518
5,527,458 A * 6/1996 Gehrmann et al. ..... 210/177

* cited by examiner

*Primary Examiner*—Kenneth Rinehart
(74) *Attorney, Agent, or Firm*—Alix, Yale & Ristas, LLP

(57) ABSTRACT

The invention relates to a device for device for continuous drying of material, particularly sewage sludge, which has a belt 2, particularly a filter belt, on which the material is conveyed. It is characterised by a distribution screw 4 being mounted above the belt 2, particularly filter belt, at the inlet in order to feed the material onto the belt 2, particularly filter belt. In addition, the invention relates to a process for drying material, particularly sewage sludge, where the material is conveyed on a belt 2, particularly a filter belt, through a dryer 1, which process is characterised by the material being fed in through a distribution screw 4, where the level can be changed by altering the belt speed.

28 Claims, 4 Drawing Sheets

DEVICE FOR CONTINUOUS DRYING OF MATERIAL

BACKGROUND OF THE INVENTION

The invention relates to a device for continuous drying of material, particularly sewage sludge, which has a belt, particularly a filter belt, on which the material is conveyed. In addition, the invention relates to a process for drying material, particularly sewage sludge, where the material is conveyed on a belt, particularly a filter belt, through a dryer.

Belt dryers have long been used for different purposes. Their disadvantage to date has been uneven distribution of the material on the revolving belt, particularly filter belt, which causes excessive drying of the material in places where the layer was too thin and insufficient drying at other points where the layer was too thick. When paste-like and/or sticky substances, e.g. sewage sludge, are dried, they have to be shaped into particles as close to the same size as possible before being distributed evenly over the belt, particularly a filter belt. This is achieved in plants for sewage sludge according to the state of the art by pressing these substances at high pressure through matrices. Practice has shown that these matrices tend to become clogged due to foreign matter in the product to be dried, which in turn has a very disadvantageous effect on even drying. Furthermore, the dryer has sometimes to be shut down once per shift to clean these matrices. A plant of this type is described in WO 92/00250. This type of plant is also known from EP 0 781 741 B1 or EP 0 889 014 B1. In addition, these systems are highly sensitive to changes in the sludge properties.

SUMMARY OF THE INVENTION

The aim of the invention is thus to provide a process and a device that will guarantee even distribution of the material to be dried, particularly paste-like or sticky substances, over the belt, particularly filter belt, of a belt dryer.

In a general aspect, the invention can be considered a device for continuous drying of material, especially sewage sludge material, comprising a drying hood, a belt for conveying the material in a conveying direction through the drying hood, and material distribution means located above the belt proximate the inlet end, for receiving material to be dried and distributing the material at a substantially constant rate across the belt.

Preferably, the material distribution means includes a distribution screw having a rotation axis oriented transversely to the belt conveying direction, and means for rotating the screw at a constant speed. The level can be controlled by adjusting the speed of rotation of the screw.

The invention is thus characterised by a distribution screw being mounted above the belt, particularly filter belt, at the inlet in order to feed the material onto the belt, particularly filter belt. With this design, material to be dried, for example wood chips, biomass, grain, reject material in paper mills, as well as household waste or sewage sludge, can be distributed relatively evenly over the belt, particularly filter belt, of the dryer.

An advantageous further development of the invention is characterised by a calibrating roll being mounted above the belt, particularly filter belt, where the calibrating roll can be height-adjustable. If, in addition, a level sensor is mounted near the distribution screw, this will provide greater evenness of distribution for drying.

It has proved an advantage if the calibrating roll rotates in the opposite direction to the conveying direction of the belt, particularly filter belt, where the rotation speed can be higher than the belt speed. This has the effect of recirculating the excess amount of material to be dried back to the vicinity of the distribution screw, thus achieving greater evenness of distribution.

In drying of paste-like and/or sticky substances, for example sewage sludge, it is an advantage if the distribution screw is connected to a mixer for mixing backfeed material, particularly a partial flow of the dried final product, and fresh material, particularly wet sludge, where the mixer can be a plough blade mixer, a double shaft mixer, or a paddle mixer. If material that has already been dried is backfed to the fresh material, for example wet sludge, the air permeability of this paste-like and/or sticky substance can be set at a certain level and a favourable effect is achieved on even distribution over the belt, particularly filter belt.

If the mixer is connected to a discharge device for backfeed material from a backfeed silo and if the backfeed silo has a discharge device, particularly a discharge screw, for the accept material, for example granulate, a particularly low-cost and dependable plant can be obtained, where the amount of accept material discharged, e.g. granulate, is controlled automatically.

A particularly low-cost variant of a dryer can be achieved if a dryer hood is mounted over the belt, particularly filter belt, which extends over the entire belt, particularly filter belt, including the distribution screw, where the dryer can have feed ducts that run along both sides of the dryer and openings for the drying gas to escape.

If the feed ducts are connected to one another by means of adjustable tie rods, the dryer hood can be designed as a very light structure and be set to form an optimum seal towards the frame of the dryer.

In dryers with a large throughput, a low-cost design is achieved by making the entire base of the dryer or the entire dryer housing of concrete.

If condensation of exhaust vapour or post-treatment in a biofilter is used to keep environmental pollution down, it is an advantage to provide distribution devices, particularly showers, under the belt, particularly filter belt.

The invention also relates to a process for drying material, particularly sewage sludge, where the material is conveyed on a belt, particularly a filter belt, through a dryer. It is characterised by the material being fed in through a distribution screw, where the level can be changed by altering the belt speed, where the belt, particularly filter belt, accelerates if the level in the distribution screw rises and slows down if the level in the distribution screw drops, until the level returns to the set value.

With paste-like and/or sticky substances, it is a particular advantages if the material to be dried, consisting of fresh material, particularly wet sludge, and backfed material, particularly granulate, and the backfed material is taken in controlled quantities from a storage container, particular a backfeed silo, where the excess dried material, particularly granulate, can be taken from the storage container as accept material. This provides a particularly reliable form of automatic control on the amount of accept material discharged.

In order to minimize environmental pollution it is an advantage if water is sprayed into the dryer below the belt, particularly filter belt, and the exhaust vapour is condensed and saturated, respectively.

BRIEF DESCRIPTION OF THE DRAWINGS

The invention will now be described using the examples in the drawings, where.

DESCRIPTION OF THE PREFERRED EMBODIMENTS

Figure 1:
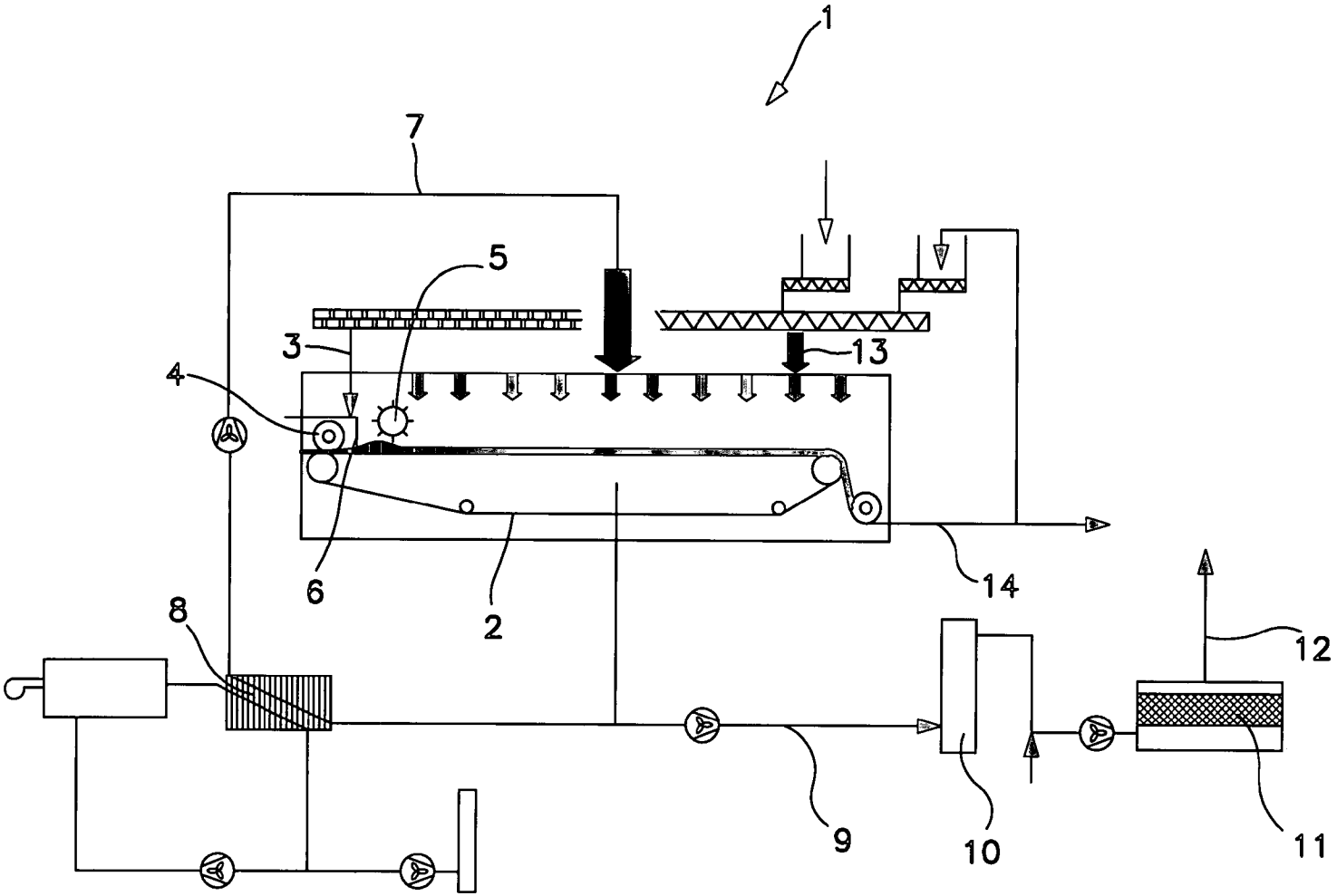
FIG. 1 contains a schematic diagram showing the principles of a belt dryer according to the invention.

FIG. 1 is a schematic diagram of a dryer 1 with a belt, particularly a filter belt 2, in which material 3 to be dried is fed through a distribution screw onto the belt, particularly filter belt 2, and then evened out by a calibrating roll 5. The belt, particularly filter belt, used here can be made of plastic or metal fabric. In the vicinity of the distribution screw 4 there is a level sensor 6 that controls the belt speed, where the belt, particularly filter belt, accelerates when the level in the distribution screw rises and the belt speed is reduced when the level in the distribution screw drops, until the level returns to the set value. Since the material is thrown backwards by the calibrating roll 5, even distribution is achieved after the calibrating roll on the one hand, and on the other hand, at higher feed levels the material is directed into the vicinity of the sensor, which means that the belt speed control is triggered promptly.

Drying is effected by hot air feed through a circulating air duct 7, where the hot air is heated here for example in a heat exchanger 8 using exhaust heat, e.g. by steam, flue gas, or hot water. The air for this can also be heated directly or indirectly by a burner. The air removed from the air circulating system and which contains moisture (exhaust vapour) is removed partly through a duct 9, fed to a condenser/saturator 10, and possibly to a biofilter 11, before the exhaust air 12 is emitted into the atmosphere. Before the dried material 14 leaves the dryer, it is advantageous to cool it with cooling air 13. This cooling air can be sucked in from the surrounding area, perhaps by means of the partial vacuum prevailing in the dryer, or as air extracted from the peripheral components.

Figure 2:
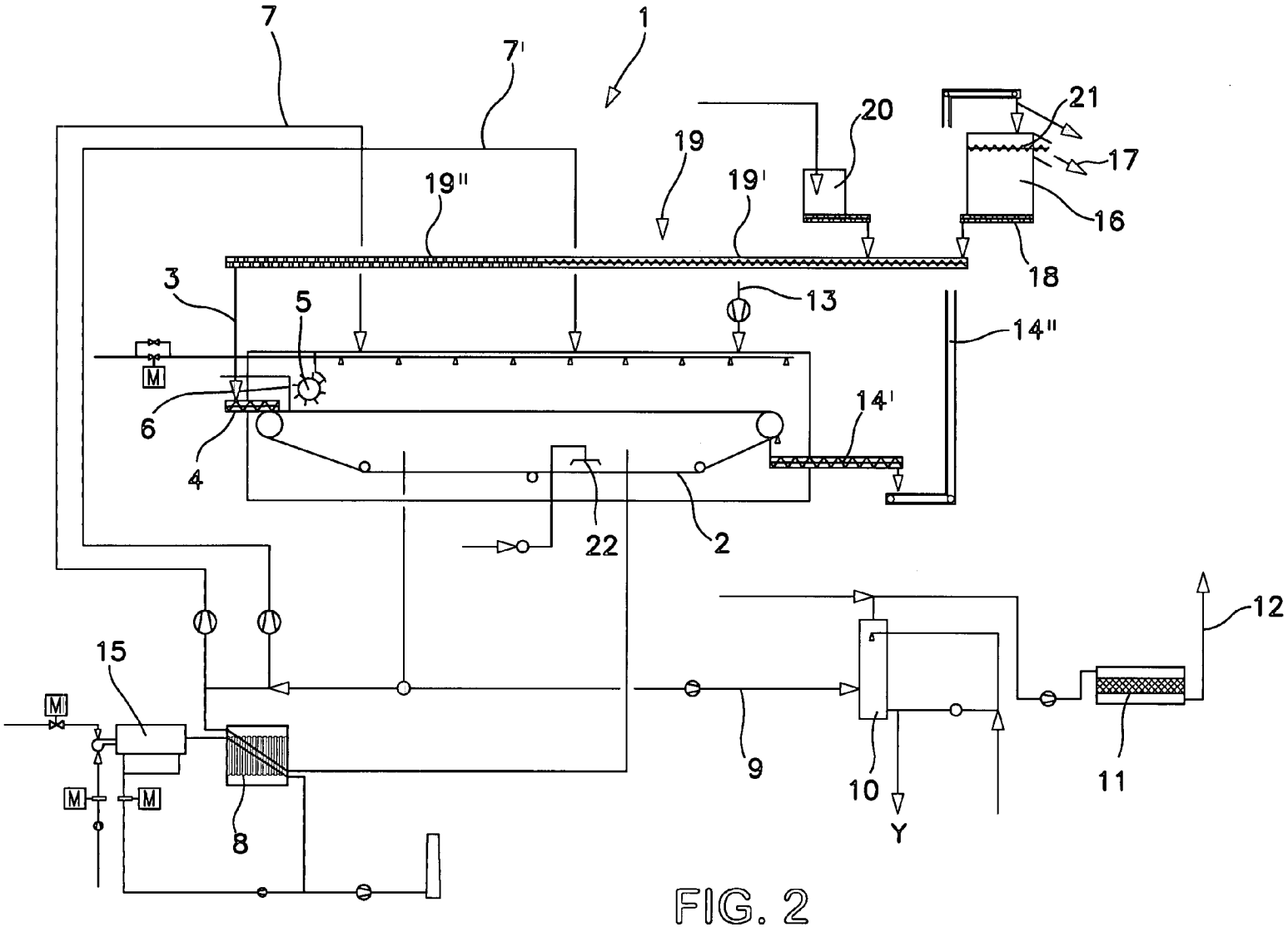
FIG. 2 provides a schematic diagram of a belt drying plant according to the invention.

In FIG. 2, identical parts have the same reference numbers as in FIG. 1. In addition, this illustration shows a means of applying hot air through ducts 7 and 7' into two or more heating zones. Flue gases from a burner 15 are used for the heating process in the heat exchanger 8. In addition, it would also be possible to use hot water, steam or thermal oil for heating purposes.

The dried material, for example granulate, is brought by a conveying screw 14' and a conveying element 14' to a backfeed silo 16, from where the accept material or final product 17 is taken. The backfeed product is fed to the mixer 19 by the dosing screws 18 and mixed with fresh material or wet sludge from a storage tank 20. The mixer can comprise a conveying zone 19' and a mixing zone proper 19", as shown here, and feeds the mixed material 3 to the distribution screw 6. The dried product from the dryer 1 is discharged into the silo 16. The excess final product is discharged via a discharge screw 21 mounted in the upper part of the silo 16 and then brought to different process stages, e.g. stacking in the silo, packing in big bags, incineration, or similar. This arrangement is a particularly low-cost and reliable variant because the discharge amount is self-regulating. The more dried material there is, the more material is discharged. If there is less material to be dried, nothing is discharged until the material reaches the level of the discharge screw 21 again. This also guarantees that there is always sufficient material available for backfeeding. If the volume is selected accordingly, there will also be sufficient material available for re-starting if the plant is shut down. Furthermore, there should also be enough space to empty the dryer completely if the plant is shut down. In addition, the showers 22 that are used to spray in water for condensation and saturation of the exhaust vapour, respectively, are shown here.

Figure 3:
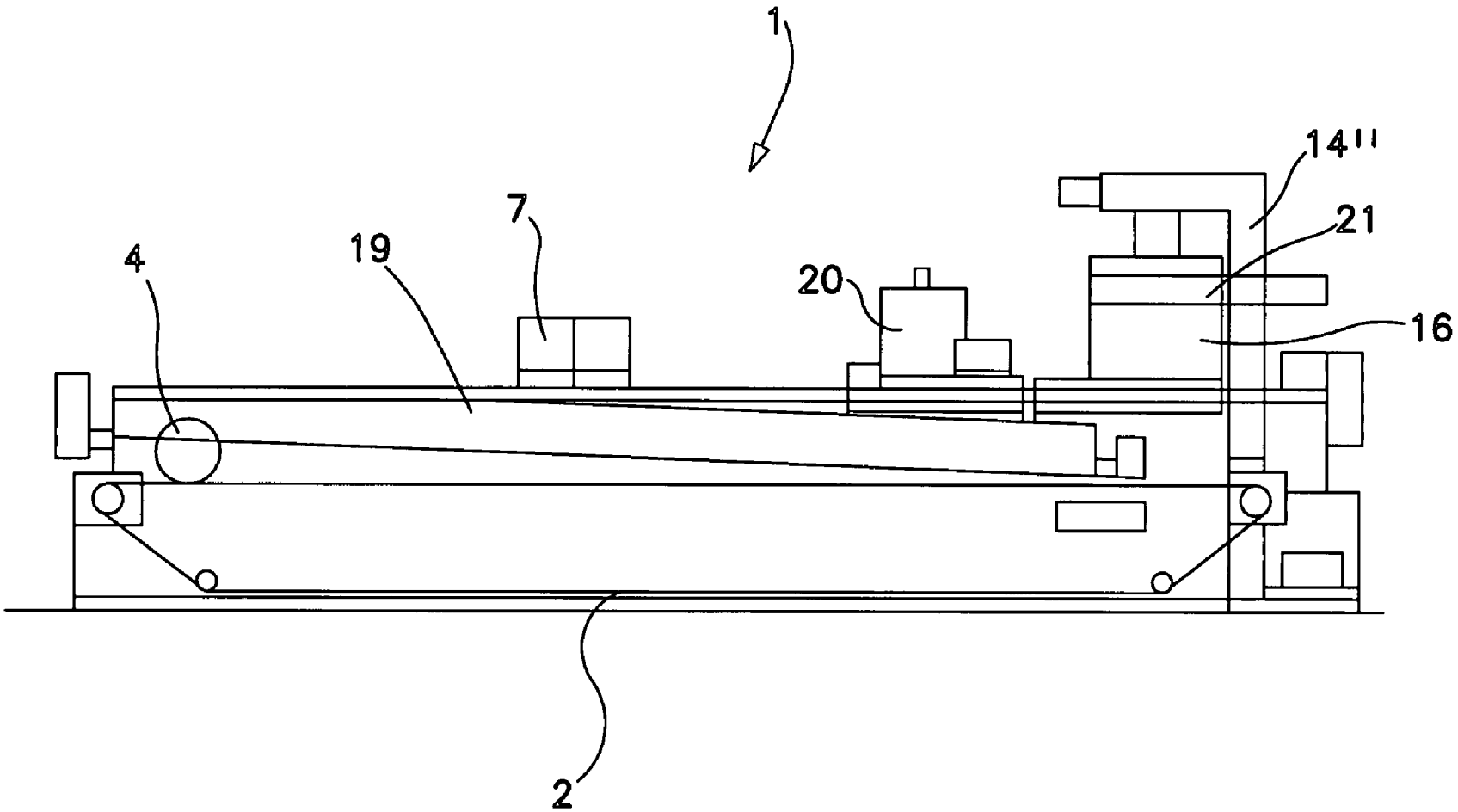
FIG. 3 contains a longitudinal view.

FIG. 3 shows a longitudinal view of the dryer 1, with the mixer 19 and the silos 16 and 20 in the background.

Figure 4:
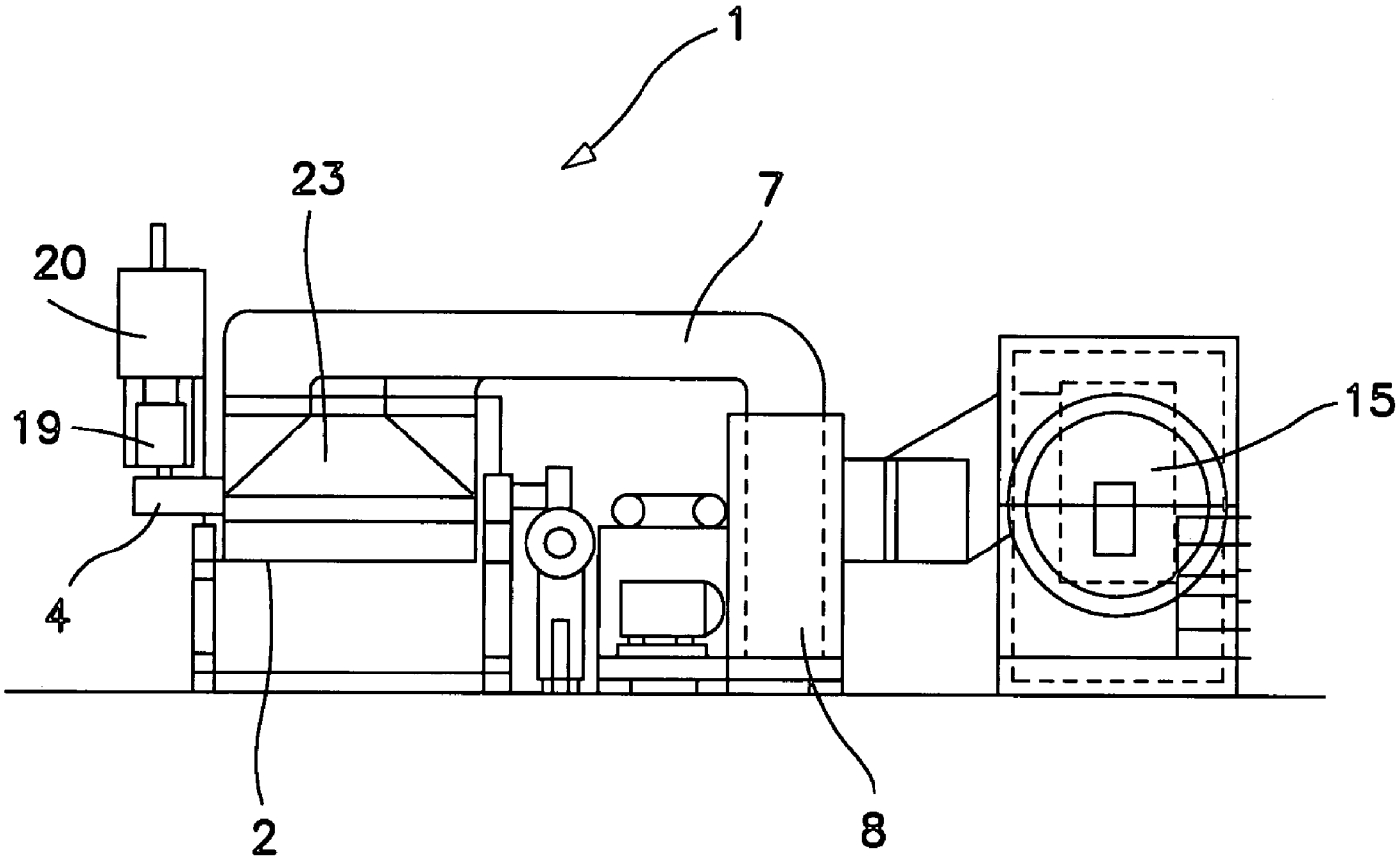
FIG. 4 is a transverse view of a dryer according to the invention.

In FIG. 4, a transverse view is shown of a dryer 1 according to the invention. Here, we can also see the wet material silo 20 and the mixer 19, as well as the air feed duct 7 complete with heat exchanger 8 and burner 15. In addition, this illustration shows the drying hood 23 above the belt 2.

The invention claimed is:

1. A device for continuous drying of material comprising:

a belt for conveying said material in a conveying direction through a dryer, said belt having an inlet end;

a distribution screw mounted above the belt proximate the inlet end so that the screw rotation axis is transverse to the conveying direction, for substantially evenly distributing the material onto the belt; and a rotating calibrating roll mounted above the belt at a down stream position from the distribution screw, wherein the calibrating roll is height-adjustable.

2. The device according to claim 1 including a level sensor mounted proximate to the distribution screw.

3. The device according to claim 1, wherein the belt is a filter belt.

4. The device according to claim 1, wherein the material is sewage sludge.

5. The device according to claim 1, wherein the calibrating roll rotates in an opposite direction to the conveying direction of the belt.

6. The device according to claim 5, wherein the calibrating roll rotates at a higher speed than the conveying speed the belt.

7. A device for continuous drying of material comprising:

a belt for conveying material in a conveying direction through a dryer, said belt having an inlet end;

a distribution screw mounted above the belt proximate the inlet end so that the screw rotation axis is transverse to the conveying direction, for substantially evenly distributing the material onto the belt;

wherein the distribution screw is connected to a mixer for mixing a backfeed material and a fresh material.

8. The device according to claim 7, including a rotating calibrating roll mounted above the belt at a down stream position from the distribution screw.

9. The device according to claim 8, wherein the calibrating roll rotates in an opposite direction to the conveying direction of the belt.

10. The device according to claim 9, wherein the calibrating roll rotates at a higher speed than the conveying speed the belt.

11. The device according to claim 7, wherein the mixer is a plough blade mixer, a double shaft mixer, or a paddle mixer.

12. The device according to claim 11, including a backfeed silo and a discharge device for backfeed material associated with the backfeed silo, and wherein said mixer is operatively connected to the discharge device for backfeed material.

13. A device for continuous drying of material comprising:

a belt for conveying material in a conveying direction through a dryer, said belt having an inlet end;

a distribution screw mounted above the belt proximate the inlet end so that the screw rotation axis is transverse to the conveying direction, for substantially evenly distributing the material onto the belt;

a dryer having a dryer hood mounted over the belt, said dryer hood extending over the entire belt and the distribution screw;

wherein the dryer has feed ducts that extend along both sides of the dryer hood, and openings for the drying gas to escape.

14. The device according to claim 13, wherein the dryer hood is made of concrete.

15. The device according to claim 13, wherein the feed ducts are connected to one another by adjustable tie rods.

16. The device according to claim 13, including distribution devices positioned under the belt for condensation and saturation of exhaust vapour.

17. The device according to claim 13, including a rotating calibrating roll mounted above the belt at a down stream position from the distribution screw.

18. The device according to claim 17, wherein the calibrating roll rotates in an opposite direction to the conveying direction of the belt.

19. The device according to claim 18, wherein the calibrating roll rotates at a higher speed than the conveying speed the belt.

20. A device for continuous drying of sewage sludge material comprising:

a drying hood;

a belt for conveying the material in a conveying direction through the drying hood, said belt having an inlet end; and material distribution means located above the belt proximate the inlet end, for receiving material to be dried and distributing the material at a substantially constant rate across the belt;

wherein the material distribution means includes a distribution screw having a rotation axis oriented transversely to the belt conveying direction, and means for rotating the screw at a constant speed.

21. A process for drying sewage sludge material comprising the steps of:

conveying the material on a belt driven at a given speed through a dryer;

feeding the material to a distribution screw located over an inlet end of the belt;

distributing the material onto the inlet end of the belt with the distribution screw as a layer of material to be dried, having a substantially even level across the belt; and in response to measurement of a process variable, changing the level of the material on the belt by altering the belt speed.

22. The process for drying material according to claim 21 including the steps of adjusting a gas permeability of the material by forming the material by mixing a fresh material to be dried with an already dried material.

23. The process for drying material according to claim 21 including the steps of accelerating the belt if a level of the material in the distribution screw exceeds a set value; and maintaining the acceleration until the material level returns to the set value.

24. The process for drying material according to claim 21 including the steps of slowing the belt if a level of the material in the distribution screw falls below a set value; and maintaining the acceleration until the material level returns to the set value.

25. The process for drying material according to claim 21 including the steps of additionally evening the substantially even layer of material with a calibrating roll by returning a portion of the material which has been distributed in the substantially even layer over the portion of the belt to a position near the distribution screw.

26. The process for drying material according to claim 21, wherein the material is a mixture of fresh material and backfed material, and includes the steps of removing a portion of backfed material from a storage container; and mixing the backfeed material with a fresh material.

27. The process for drying material according to claim 26 including the steps of maintaining a level in a backfed storage container; and discharging backfed material from the backfed storage container when the level is exceeded.

28. The process for drying material according to claim 21 including the steps of spraying water from below the belt; and condensing and saturating an exhaust vapour.

* * * * *

UNITED STATES PATENT AND TRADEMARK OFFICE

CERTIFICATE OF CORRECTION

PATENT NO. : 7,028,414 B2
APPLICATION NO. : 10/835489
DATED : April 18, 2006
INVENTOR(S) : Vonplon It is certified that error appears in the above-identified patent and that said Letters Patent is hereby corrected as shown below:

On the Title page, Col. 1 after section (65), insert:

--(30) Foreign Application Priority Data

Apr. 30, 2003 (AT) .....A 600/2003 --

Signed and Sealed this

Twenty-second Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,028,414 B2
APPLICATION NO. : 10/835489
DATED : April 18, 2006
INVENTOR(S) : Vonplon It is certified that error appears in the above-identified patent and that said Letters Patent is hereby corrected as shown below:

On the Title page, Col. 1 after section (65), insert:

--(30) Foreign Application Priority Data

Apr. 30, 2003 (AT) .....A 660/2003 --

This certificate supersedes Certificate of Correction issued August 22, 2006.

Signed and Sealed this

Seventh Day of November, 2006

JON W. DUDAS
*Director of the United States Patent and Trademark Office*